US007978824B2

(12) United States Patent
Motz et al.

(10) Patent No.: US 7,978,824 B2
(45) Date of Patent: Jul. 12, 2011

(54) X-RAY TUBE HAVING TRANSMISSION ANODE

(75) Inventors: Joseph W. Motz, Gaithersburg, MD (US); Donald R. Ouimette, Plantsville, CT (US)

(73) Assignee: Multi-Dimensional Imaging, Inc., Tustin, CA (US)

( * ) Notice: Subject to any disclaimer, the term of this patent is extended or adjusted under 35 U.S.C. 154(b) by 603 days.

(21) Appl. No.: 11/996,010

(22) PCT Filed: Apr. 20, 2007

(86) PCT No.: PCT/US2007/067112

§ 371 (c)(1), (2), (4) Date: Jan. 17, 2008

(87) PCT Pub. No.: WO2008/060671

PCT Pub. Date: May 22, 2008

(65) Prior Publication Data

US 2010/0111260 A1 May 6, 2010

Related U.S. Application Data

(60) Provisional application No. 60/745,213, filed on Apr. 20, 2006, provisional application No. 60/745,215, filed on Apr. 20, 2006, provisional application No. 60/867,618, filed on Nov. 29, 2006.

(51) Int. Cl.
*H01J 35/10* (2006.01)

(52) U.S. Cl. ..... 378/144; 378/121

(58) Field of Classification Search ..... 378/144, 378/119, 121, 143

See application file for complete search history.

(56) References Cited

U.S. PATENT DOCUMENTS 6,487,272 B1 * 11/2002 Kutsuzawa ..... 378/140

FOREIGN PATENT DOCUMENTS

JP 2002-352754 12/2002

* cited by examiner

*Primary Examiner* — Courtney Thomas

(74) *Attorney, Agent, or Firm* — Renner, Otto, Boiselle & Sklar, LLP

(57) ABSTRACT

An x-ray tube assembly includes an x-ray tube envelope, a cathode assembly and a transmission anode assembly. The transmission anode assembly includes an x-ray generation layer and an anode substrate. The x-ray generation layer may be annular and mounted on a rotating disc-shaped anode substrate or cylindrical and mounted on a rotating and/or oscillating cylindrical anode substrate.

34 Claims, 4 Drawing Sheets

X-RAY TUBE HAVING TRANSMISSION ANODE

RELATED APPLICATION DATA

This application claims priority of U.S. Provisional Application No. 60/745,213, filed on Apr. 20, 2006, U.S. Provisional Application No. 60/745,215, filed on Apr. 20, 2006 and U.S. Provisional Application No. 60/867,618, filed on Nov. 29, 2006, each of which is incorporated herein by reference in its entirety.

STATEMENT REGARDING FEDERALLY SPONSORED RESEARCH

This invention was made with government support under Agreement Number MDA972-03-2-0001 awarded by the Defense Advanced Research Projects Agency (DARPA). The government may have certain rights in this invention.

FIELD OF THE INVENTION

This application is a national phase of International Application No. PCT/US07/67112 filed Apr. 20, 2007 and published in the English language.

The present invention relates generally to x-ray tubes and, more particularly to an x-ray method and x-ray tube employing a transmission anode.

BACKGROUND OF THE INVENTION

Typically, a high power x-ray tube includes an evacuated envelope made of metal, ceramic or glass, which holds a cathode filament through which a heating current is passed. This current heats the filament sufficiently that a cloud of electrons is emitted, i.e., thermionic emission occurs. A high potential, typically on the order of 10-300 kilovolts, is applied between the cathode and an anode assembly, which also is located within the evacuated envelope. This potential causes electrons to flow from the cathode to the anode assembly through the evacuated region within the interior of the evacuated envelope. The electron beam strikes the anode with sufficient energy that x-rays are generated.

FIG. 1 and FIG. 2 illustrate an exemplary conventional x-ray tube 10 that includes a cathode 12 and an anode 14. Often, the anode material is tungsten with a thickness greater than 1 millimeter. Electrons 16 from the cathode 12 are accelerated and focused to a focal spot 18 on the incident (or front) surface of the anode 14, and x-rays 20 are emitted in all directions from this focal spot. A fraction of these x-rays emerge from the front anode surface and pass through a window 22 and collimator 24 aperture to constitute the emergent x-ray beam 26. Because both the incident electron beam and the emergent x-ray beam respectively enter and leave the same front anode surface, this anode is herein referred to as a reflection anode. Conventional x-ray tubes use reflection anodes because the x-rays emitted in the direction of the electron beam are mostly absorbed by the anode material, and only a small fraction is transmitted through the anode.

The geometric configuration of the cathode 12, anode 14 and collimator 24 for the x-ray tube 10 may be described by both the anode inclination (AI) angle and the x-ray emission (XE) angle, as shown in FIG. 1. The AI angle is defined as the angle between the axis of the incident electron beam and the normal, N, to the front anode surface. The XE angle is defined as the angle between the axes of the incident electron beam (this axis being projected or extended through the anode) and the emergent x-ray beam. In present day x-ray tubes, the AI angle typically is in the range of about 10 to 30 degrees, and the XE angle typically is equal to about 90 degrees.

The shape of the collimator aperture determines the shape of the x-ray beam. For example, a circular aperture provides a cone-shaped beam with its vertex at the focal spot and with the vertex half-angle equal to arc tan (r/d), where r is the radius of the collimator aperture and d is the distance of the plane of the collimator aperture from the focal spot.

In FIG. 1, a filter 28 is used at the collimator aperture for x-ray imaging applications in diagnostic radiology. This filter attenuates the x-rays primarily in the low energy region of the x-ray spectrum, and thereby reduces dose and noise to improve the quality of the x-ray image. The material and thickness of the filter depends on the x-ray attenuation properties of the object to be inspected. As a basis of comparing x-ray power outputs from different x-ray tubes, a standard filtration of 3 millimeters aluminum often is used to provide a conventional minimum filtration for diagnostic radiological procedures in medicine.

With the above features, many present day x-ray tubes have one or more of the following limitations: for cone shaped x-ray beams, the x-ray intensity distribution is asymmetric with respect to the beam axis; for cone shaped x-ray beams, the projected size of the focal spot becomes larger when observed at different points in the beam area (see focal spot 32 versus focal spot 34 in FIG. 2), which results in a "blooming effect" of the focal spot size; for cone shaped x-ray beams, the vertex half angle cannot exceed the anode inclination angle which ranges from 6 degrees to 30 degrees for present day high power x-ray tubes; and for high power tubes, the rotating anode has a large mass for high heat capacity, which imposes practical restrictions on the maximum anode diameter and rotation speed, and consequently on the maximum permissible input power and on the cooling rate that can be achieved.

SUMMARY OF THE INVENTION

The present invention provides an x-ray tube having a transmission anode. The transmission anode includes an x-ray generation layer disposed on an anode substrate. The anode assembly is configured to receive electron energy at the x-ray generation layer and to emit x-rays through the anode substrate. The provision of a transmission anode facilitates, among other things, improved x-ray yield and power, reduced focal spot blooming and wider vertex angles for cone-beam applications.

One aspect of the invention relates to an x-ray tube having an x-ray tube envelope, a cathode assembly disposed within the x-ray tube envelope, and a transmission anode assembly disposed within the x-ray tube envelope.

In accordance with another aspect, the transmission anode assembly comprises an x-ray generation layer disposed on an anode substrate.

In accordance with another aspect, the anode assembly is configured to receive electron energy at the x-ray generation layer and to emit x-rays through the anode substrate.

Another aspect of the invention relates to an anode assembly for use in an x-ray tube. The anode assembly includes an x-ray generation layer disposed on an anode substrate, wherein the anode assembly is configured to have an anode inclination angle and an x-ray emission angle that are both about zero degrees.

Another aspect of the invention relates to a method of producing an x-ray beam that includes accelerating electrons from a cathode toward an anode to produce x-rays, and using the x-rays that pass through the anode to form the x-ray beam.

The foregoing and other features of the invention are hereinafter fully described and particularly pointed out in the claims, the following description and annexed drawings setting forth in detail a certain illustrative embodiment of the invention, this embodiment, being indicative, however, of but one of the various ways in which the principles of the invention may be employed.

BRIEF DESCRIPTION OF THE DRAWINGS

The forgoing and other features of the invention are hereinafter discussed with reference to the drawings.

DETAILED DESCRIPTION

Figure 1:
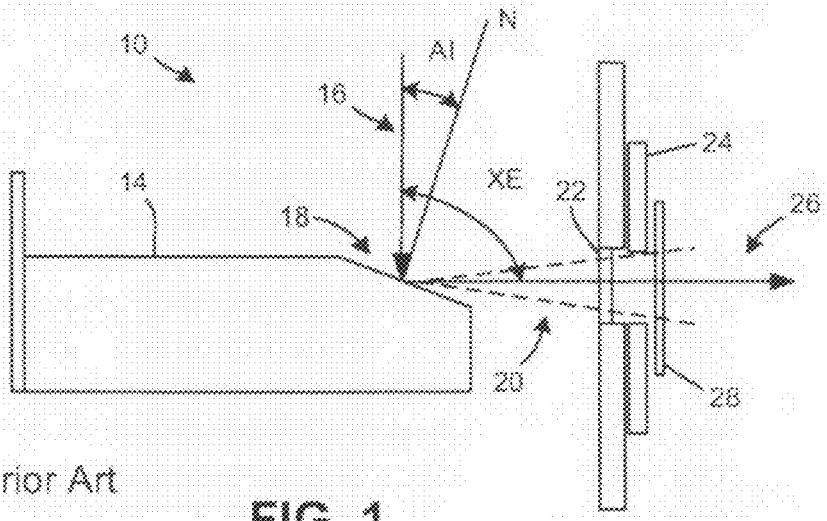
Prior Art FIG. 1
FIG. 1 is a diagrammatic illustration of a conventional x-ray tube having a reflection anode.

In the detailed description that follows, like components have been given the same reference numerals regardless of whether they are shown in different embodiments of the present invention. To illustrate the present invention in a clear and concise manner, the drawings may not necessarily be to scale and certain features may be shown in somewhat schematic form.

The present disclosure provides a transmission anode x-ray tube, where the transmission anode has an x-ray generation layer disposed on an anode substrate. The transmission anode is configured to receive electron energy at the x-ray generation layer and to emit x-rays through the anode substrate.

Figure 3:
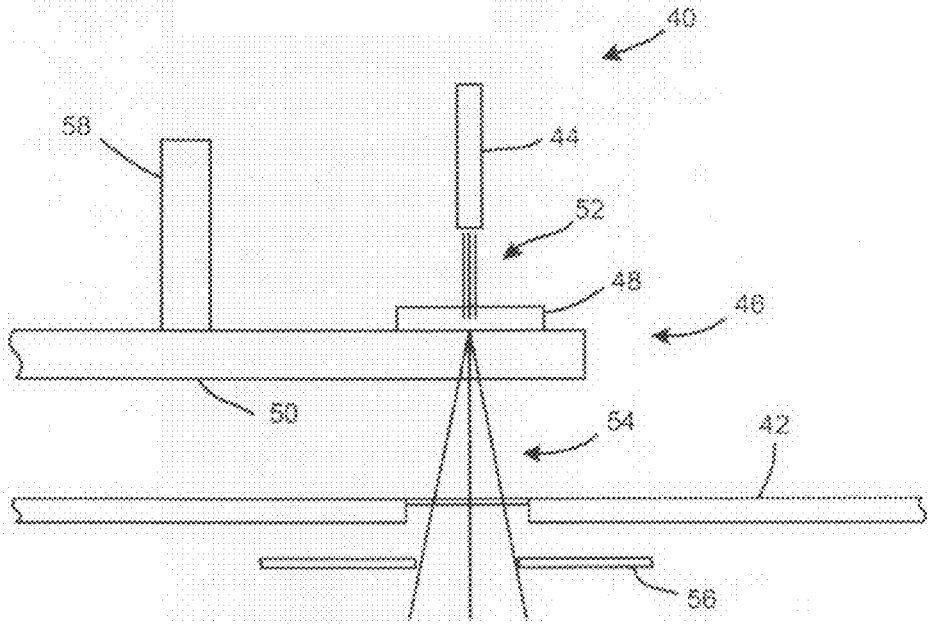
FIG. 3 is a diagrammatic illustration of an x-ray tube having a transmission anode.
Figure 4:
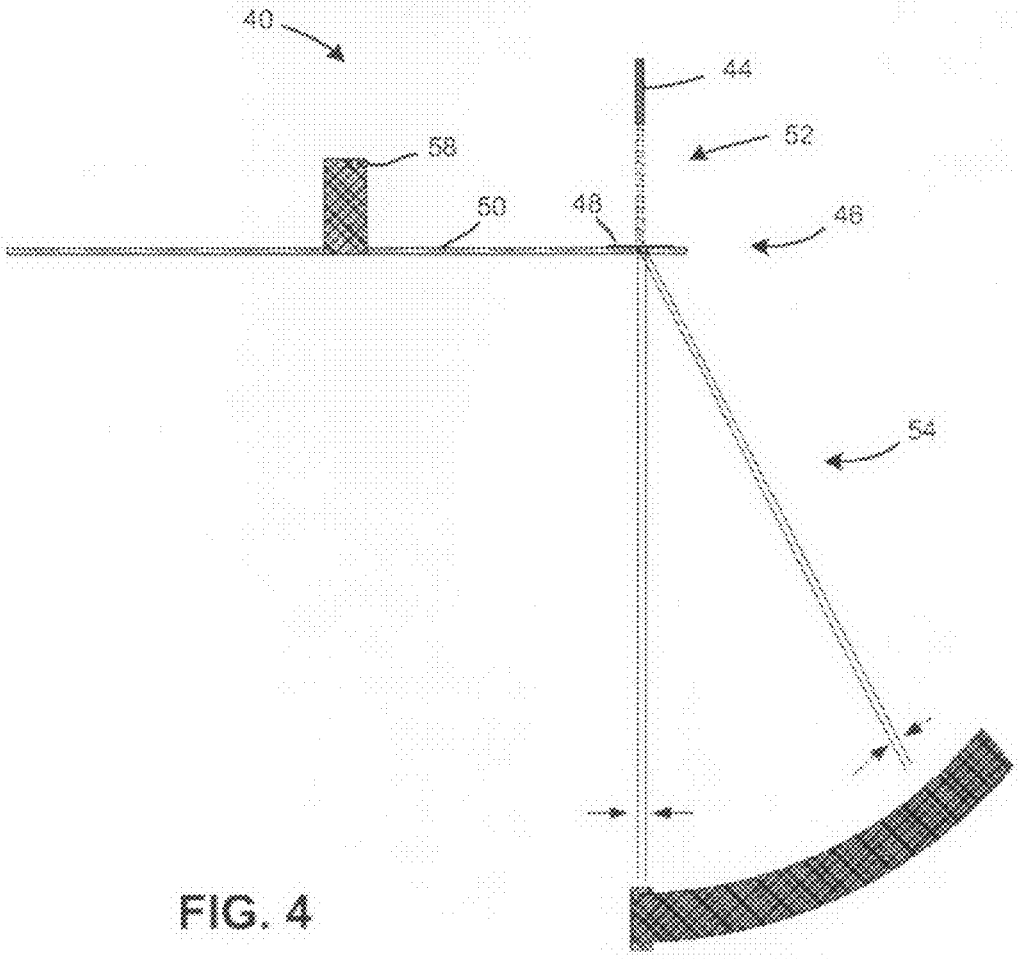
FIG. 4 is a diagrammatic illustration of an x-ray tube having a transmission anode in a computed tomography (CT) environment.

Referring now to FIG. 3 and FIG. 4, an x-ray tube 40 includes an x-ray envelope 42 in which a cathode assembly 44 (also referred to simply as the cathode) and an anode assembly 46 (also referred to as the anode or transmission anode) are disposed. The anode assembly 46 includes an x-ray generation layer 48 (also referred to as a target layer or an x-ray target layer) disposed on or above anode substrate 50. It is to be appreciated that describing the x-ray generation layer 48 as being "disposed on" the anode substrate 50 is meant to include the x-ray generation layer 48 being directly attached, connected or otherwise bonded to the anode substrate 50, as well as the x-ray generation layer being disposed on the anode substrate with one or more intervening layers, e.g., adhesive layers, filter layers or the like) between the x-ray generation layer and the anode substrate.

As is describe more fully below, the transmission anode 46, including the x-ray generation layer 48 and the anode substrate 50, is configured to receive accelerating electrons 52 from the cathode 44 and producing or otherwise generating x-rays 54, e.g., due to the interaction between the accelerating electrons and the material of the x-ray generation layer, where the generated x-rays pass through the anode substrate 50 (and optionally a collimator 56) an x-ray beam. Stated differently, the beam of accelerating electrons 52 has normal or near-normal incidence on the x-ray generating layer 48, and the x-rays emitted in the forward direction from the focal spot pass through the x-ray generating layer and through the substrate (and optionally through a collimator) to form the emergent x-ray beam. It will be appreciated that the anode assembly 46 is referred to as a transmission anode because x-rays essentially pass or otherwise are transmitted through the anode (as opposed to a conventional reflection anode where generated x-rays essentially reflect off the anode).

The geometric configuration of the cathode 44 and anode 46 (as well as any associated collimator 56) for the x-ray tube may be described by both the anode inclination (AI) angle and the x-ray emission (XE) angle, where the AI angle is defined as the angle between the axis of the incident electron beam and the normal to the anode surface, e.g., the normal to the surface of the x-ray generation layer. The XE angle is defined as the angle between the axes of the incident electron beam and the emergent x-ray beam.

While conventional x-ray tubes typically exhibit an AI angle in the range of about 6 degrees to about 30 degrees and an XE angle of about 90 degrees, the x-ray tube illustrated in FIG. 3 and FIG. 4 may be characterized by an anode inclination angle and an x-ray emission angle that may both be about zero degrees. It will be appreciated that the provision of an XE angle of about zero degrees is meant to include an XE angle of about 180 degrees, where the XE angle is measured between the axis of the incident electron beam and the emergent x-ray beam (being transmitted through the anode). Stated differently, the x-ray tube illustrated in FIG. 3 and FIG. 4 may be characterized by an XE angle of about zero degrees where the axis of the incident electron beam is projected or extended through the transmission anode. As is described more fully below, the provision of an x-ray tube capable of providing an AI angle and an XE angle of about zero degrees facilitates a larger fraction of the x-rays emitted from the focal spot (i.e., the focal spot on the x-ray generation layer) being transmitted through the anode, and emerging from the tube envelope through the x-ray window and collimator aperture. The transmitted x-ray beam has axial symmetry such that the projected off-axis focal spot size decreases as the off-axis angle increases.

As noted above, the anode may have a composite structure with an x-ray generation layer made from materials including, but not limited to tungsten or molybdenum, on a substrate material. The substrate may be made from any suitable low-density material, including, but not limited to silicon carbide, beryllium oxide, aluminum nitride or aluminum oxide. In one preferred embodiment, the anode includes a relatively thin x-ray generating layer of tungsten, e.g., about 5 microns to about 25 microns, disposed on a thicker substrate layer of silicon carbide, e.g., about 1 millimeter to about 5 millimeters. In another embodiment, the thickness of the x-ray generation layer is about 5 microns. In another embodiment, the thickness of the x-ray generation layer is about 10 microns. In another embodiment, the thickness of the x-ray generation layer is about 15 microns.

In a preferred embodiment, where the x-ray generation layer is comprised of tungsten, the thickness of the x-ray generation layer is chosen to provide the maximum x-ray output through the anode as a consequence of the competing effects of x-ray production and attenuation in the anode material, is equal to approximately one third of the electron range for a given incident electron energy (or tube kilovoltage).

Figure 5:
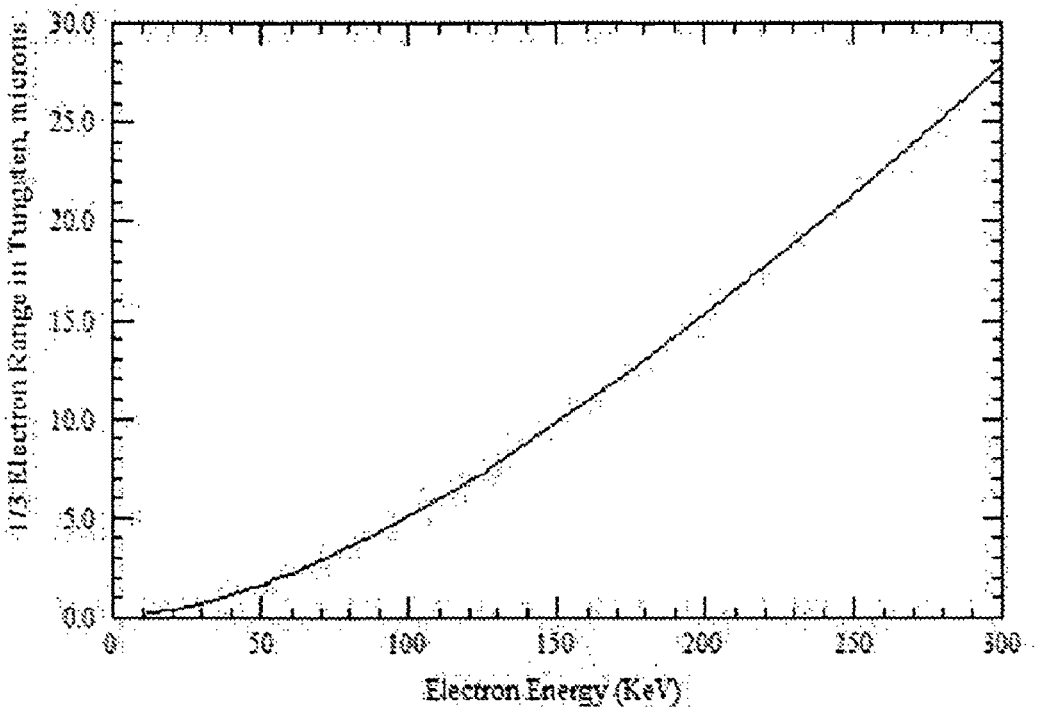
FIG. 5 is an exemplary plot of x-ray generation layer thickness vs. electron energy.

Values for the thickness of the x-ray generation layer as a function of the tube kilovoltage are shown in FIG. 5 in the region from 50 kilovolts to 500 kilovolts.

The x-ray generation layer may be deposited on a substrate material for mechanical stability, since preferred thicknesses as shown in FIG. 5 typically are of the order of about 5 microns to about 25 microns. Because the x-rays produced in the x-ray generation layer are further attenuated after transmission through the substrate, the substrate can replace any external filter (such as the external filter often used a conventional reflection anode tube. As noted above, the substrate may be made from any suitable material having an atomic number and thickness that approximately match the attenuation properties of a typical external filter. The filtration effected by the substrate may be used to attenuate the lower energy region of the x-ray spectrum in order to obtain improved x-ray images.

Figure 6:
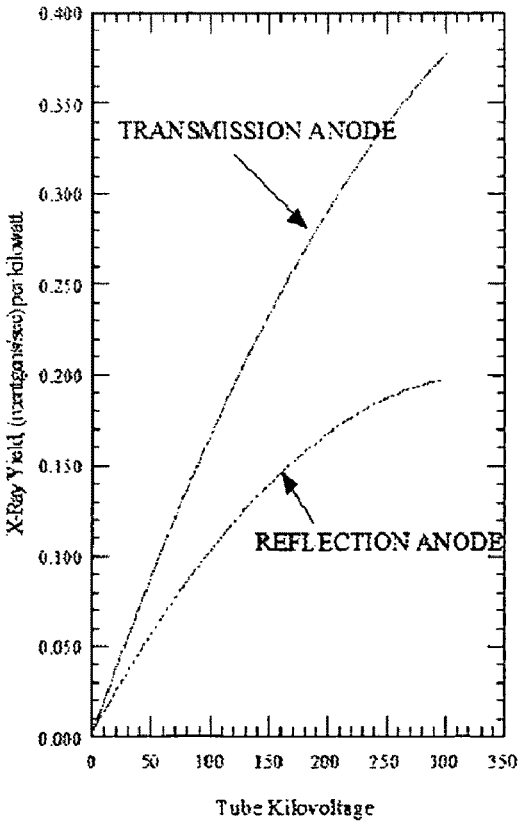
FIG. 6 is an exemplary plot of x-ray yield vs. tube kilovoltage comparing an x-ray tube having a transmission anode to an x-ray tube having a reflection anode.

In one embodiment, the substrate may be selected to be about 3 millimeters silicon carbide (which approximately matches the 3 millimeters aluminum used as the external filter in the definition of the x-ray yield). It is that the 3 millimeters aluminum filter specified for the measurement of the exposure rate is a baseline filter that is introduced to permit quantitative comparisons of the x-ray yield based on the same attenuated x-ray spectrum for both the reflection and transmission anode tubes (see FIG. 6). The silicon carbide substrate has desired thermal properties for high power operation, such that it has high heat conductivity and melting temperature, and its thermal expansion is comparable to tungsten. Other materials or thicknesses may be used for this substrate with the condition that the substrate plus any external filters provide the filtration desired for a specific radiological application.

The transmission anode may be stationary or may rotate about a central axis 58 (also referred to as an anode axis or anode shaft). Also, the transmission anode may take on multiple geometries without departing from the scope of the present invention. FIG. 3 and FIG. 4 depict an exemplary embodiment in which the transmission anode 46 may have the shape of a circular disc, where the substrate 50 is disc-shaped and the x-ray generation layer is annular 48. Other variations of this geometry or other geometries may be employed. In the rotating disc embodiment, as the disc rotates, the focal spot formed by the electron beam at the disc radius becomes a circular focal track with a width given by the size of the focal spot on the anode surface. The structure of the disc in the region of the focal track is the same as the composite structure for the transmission anode as described above. With this rotating disc, the heat load (or the electron deposition energy) in the focal spot region may be transferred to the much larger focal track region. Accordingly, the focal track temperature for a given electron input power and exposure time, is determined by the disc diameter, mass and rotation speed.

Figure 7:
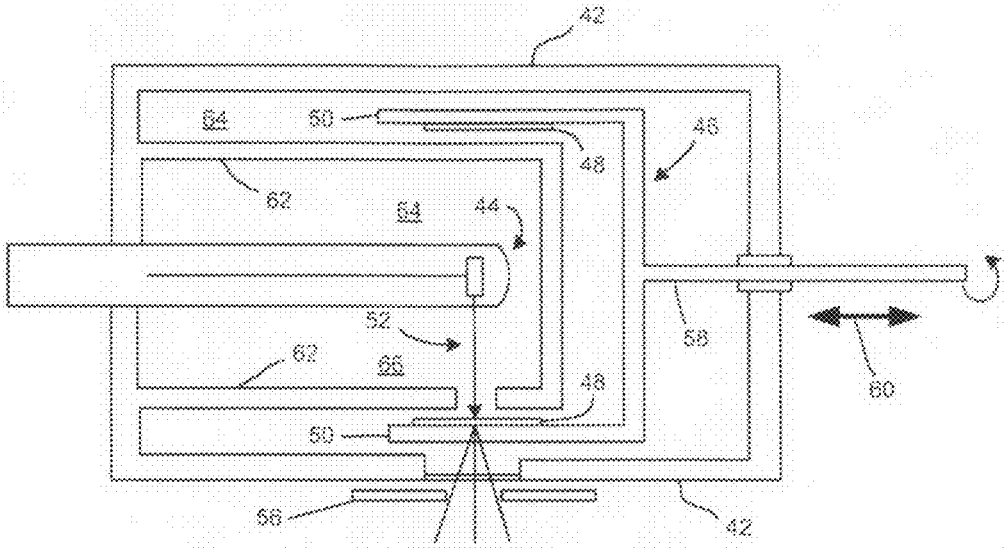
FIG. 7 is a cross-sectional diagrammatic illustration of an x-ray tube having a cylindrical transmission anode in accordance with another embodiment of the invention.

Referring now to FIG. 7, an alternative embodiment of an x-ray tube 40 having a rotating and/or oscillating cylindrical transmission anode 46 is provided. In the illustrated embodiment, the rotating transmission anode 46 is substantially cylindrical in shape with the cathode 44 located at least partially within the cylinder defined by the rotating transmission anode, and the focused electron beam 52 directed along a radius to the inner surface of the cylinder, as shown in FIG. 7. The focal track thus is along the inner circumference of the cylinder defined by the x-ray generating layer 48 disposed on the substrate 50. In the illustrated embodiment, the anode substrate is substantially cylindrical with a substantially cylindrical x-ray generation layer disposed thereon.

The rotating cylindrical transmission anode provides a means for increasing the focal track width without changing the size of the focal spot or the position and direction of the electron beam emerging from the cathode. This may be accomplished by oscillating the rotating cylinder in the direction of its rotation axis (along the direction of arrow 60). With these two superimposed motions of rotation and oscillation, a spiral focal track may be produced which may encompass much, if not all, of the inner surface of the x-ray generation layer. The width of the focal track on the x-ray generation layer is thus effectively increased from the width of the focal spot for a single focal track to a width equal to the total amplitude of the oscillation. This increased width of the focal track may effectively extend beyond a distance of twice the oscillation amplitude, depending on the heat conductivity and total length of the cylinder. The corresponding increase in the area of the circumferential focal track now increases the rate of heat loss by radiation, which depends on both the fourth power of the focal track temperature, and on the area of both the inner and outer radiating surfaces of the cylinder (or twice the focal track width).

With continued reference to FIG. 7, to obtain an effective radiation cooling rate for the cylindrical anode, an inner heat shield 62 (also referred to as a heat sink) is provided. The heat sink 62 surrounds or substantially surrounds the inner surface cylindrical x-ray generation layer 48 and has an aperture for the electron beam 52 emitted from the cathode 44. Both the inner heat sinks 62 and the x-ray envelope 42, which surround the inner and outer surfaces of the cylindrical transmission anode, preferably are in thermal communication and maintained at room temperature (or some other relatively cooler temperature). In one embodiment, the inner heat sinks are formed integrally with the x-ray envelope. This configuration improves the radiation cooling rate, and at the same time provides a low or even zero electric field environment for the anode such that there is no voltage gradient for charged particles emitted from the anode surface during the tube operation.

As discussed above with respect to FIG. 3 and FIG. 4, in a preferred embodiment, the cylindrical transmission anode has a composite structure with a substantially cylindrical x-ray generation layer, e.g., a tungsten or molybdenum layer, deposited or otherwise disposed on a cylindrical substrate over the area that is scanned by the incident electron beam. The cylindrical substrate may be made of any suitable low-density material, including, but not limited to, silicon carbide, beryllium oxide, aluminum nitride or aluminum oxide.

In a preferred embodiment, where the x-ray generation layer is comprised of tungsten, the thickness of the x-ray generation layer is chosen to provide the maximum x-ray output through the anode as a consequence of the competing effects of x-ray production and attenuation in the anode material, is equal to approximately one third of the electron range for a given incident electron energy (or tube kilovoltage). Values for the thickness of the x-ray generation layer as a function of the tube kilovoltage are shown in FIG. 5 in the region from 50 kilovolts to 500 kilovolts.

The x-ray generation layer may be deposited on a substrate material for mechanical stability, since optimum thicknesses (as shown in FIG. 5) typically are of the order of about 5 microns to about 25 microns. Because the x-rays produced in the x-ray generation layer are further attenuated after transmission through the substrate, the substrate can replace any external filter (such as the external filter often used a conventional reflection anode tube. As noted above, the substrate may be made from any suitable material having an atomic number and thickness that approximately match the attenuation properties of a typical external filter. The filtration effected by the substrate may be used to attenuate the lower energy region of the x-ray spectrum in order to obtain improved x-ray images.

In an embodiment having a tungsten x-ray generation layer disposed on a silicon carbide substrate, x-rays are produced in the tungsten layer and are transmitted through the silicon carbide substrate. The substrate now replaces any external filter (such as the external filter that might be used with a conventional reflection anode tube. The cylindrical anode substrate may be include any suitable material having an atomic number and thickness that may approximately match the attenuation properties of an external filter.

The silicon carbide substrate has good thermal properties for high power operation, such that it has high heat conductivity and melting temperature, and its thermal expansion is comparable to tungsten. Other materials or thicknesses may be used for this substrate, preferably such that the substrate plus any external filters provide the filtration desired for a specific radiological application.

The cylindrical transmission anode configuration illustrated in FIG. 7 includes the provision of a Stefan-Boltzman cooling chamber 64, wherein the inner heat sinks and outer cylindrical heat sinks (x-ray envelope) enclose a radiation cooling chamber which contains the high temperature anode. The cooling process is based on the Stefan-Boltzman law which states that the anode cooling rate is proportional to the fourth power of the absolute temperature (degrees Kelvin) of the anode cylinder, the inner and outer surface area of the anode cylinder wall, and the emissivity of (a) the inner and outer surface area of the anode cylinder wall, (b) the outer surface area of the inner heat sink, and (c) the inner surface area of the outer heat sink.

In addition, the cylindrical transmission anode configuration enjoys a heat sink for scattered electron energy. A relatively large fraction of the incident electron energy is scattered from the focal spot into the backward hemisphere. This scattered electron energy is mostly absorbed by the outer surface of the inner heat sink 62, which has a relatively low atomic number to minimize the ratio of elastic to inelastic electron scattering. This containment avoids undesirable electric charge or heating effects that may otherwise occur in the insulator regions of the x-ray tube.

The focal spot region is located on the inner surface of a rotating cylinder. Accordingly, there is a large centrifugal force which maintains the integrity of the tungsten material in the focal spot region during any dynamic changes, such as a phase change during a microsecond temperature rise above its melting temperature or a continuous location change on the inner surface of the cylinder because of its rotating and oscillating motion. This centrifugal force may have values equal to several thousand times the acceleration of gravity depending on the diameter and rotation speed of the cylinder. (For example, with a 6 inch diameter cylinder and a rotation speed of 10000 rpm, this force is equal to approximately 8500 g, where g is 980 $cm/s^2$). In this confining centrifugal force field, the focal spot region experiences a negligible change in the integrity of the material (such as the number of tungsten atoms), even after being cycled through a microsecond phase change that is produced by the electron energy deposition in the moving tungsten layer on the inner surface of the rotating cylindrical anode. As a consequence, the peak anode temperature may exceed the melting temperature of tungsten with no deleterious effects on the tungsten layer, and with only a negligible change in the x-ray output. Accordingly this x-ray tube may possibly be operated in regions of much greater power inputs than is permissible for present day x-ray tubes.

Also, the cylindrical transmission anode configuration enjoys dual chambers for reduction of arc discharges. High voltage x-ray tubes are prone to arc discharges because of the existence of charged particles in high gradient electric fields in the vicinity of the high temperature anode. To alleviate this condition this tube has two separate chambers: the Stefan-Boltzman cooling chamber 64 (having, for example, a relatively lower vacuum) and the electron acceleration chamber 66 (having, for example, a relatively higher vacuum). The cooling chamber 64 has the high temperature anode with surrounding charged particles in a zero-gradient electric field, and the acceleration chamber 66 has a lower temperature with fewer charged particles (not including the anode region) with a central high voltage cathode post that has axial symmetry and a reduced electric field gradient.

Figure 8:
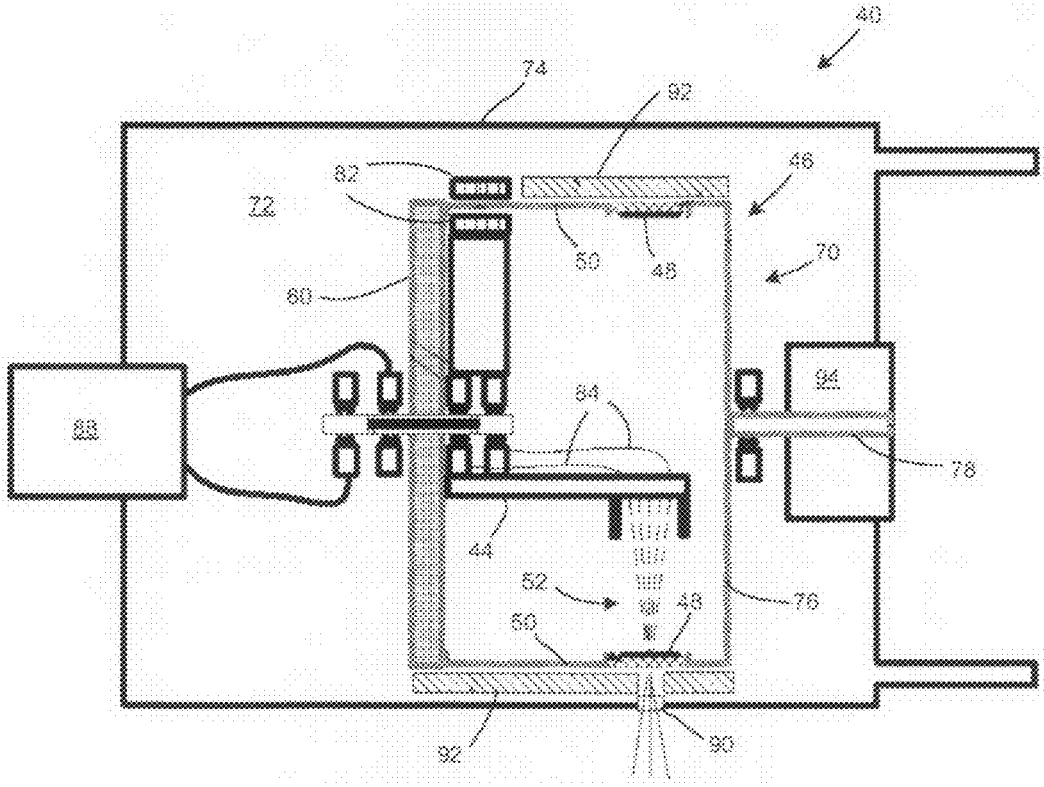
FIG. 8 is a cross-sectional diagrammatic illustration of an x-ray tube having a cylindrical transmission anode in accordance with another embodiment of the invention.

Referring now to FIG. 8, an alternative embodiment of an x-ray tube 40 having a rotating and/or oscillating cylindrical transmission anode 46 is provided. In the illustrated embodiment, the rotating transmission anode 46 has the shape of a cylinder with the cathode 44 located at least partially within the cylinder defined by the rotating transmission anode, and the focused electron beam 52 directed along a radius to the inner surface of the cylinder, as shown in FIG. 8. The focal track thus is along the inner circumference of the cylinder. In the illustrated embodiment, anode substrate is substantially cylindrical with a substantially cylindrical x-ray generation layer disposed thereon.

The cylindrical transmission anode depicted in FIG. 8 includes an alternative geometry that is conducive to effective cooling of the rotating envelope (indicated generally as 70). As is described more fully below, the x-ray tube 40 includes a rotating cylindrical transmission anode 46 that is in direct thermal contact with the x-ray envelope 70 with the transmission anode and x-ray envelope rotating in a thermally conductive cooling medium 72.

FIG. 8 depicts a cross-sectional view of an exemplary rotating envelope 70 in an x-ray tube housing 74 having suitable cooling fluid 72. In one embodiment, the rotating envelope 70 includes a cylinder with an end cap 76 and a rotation shaft 78 that is made from a compatible material, such as kovar, that can be bonded and sealed to the anode substrate 50 cylinder. The anode substrate 50 in this embodiment is a cylindrical ring of material that is hermetically sealed to the envelope material. The inside surface of the anode substrate material is coated with a suitable x-ray generation layer 48, such as tungsten or molybdenum. The other end of the envelope may include an end member 80, made from a suitable insulating material, such as high voltage ceramic that is hermetically sealed to the rotating envelope cylinder. The high voltage insulating end plate of the rotating envelope may or may not have a rotation shaft. These components describe the section of the tube defining the vacuum envelope that will rotate. It is also understood that detailed construction of the rotating envelope can be of any combination of specific materials. The whole envelope could be made of silicon carbide or any other suitable material with an insulating endplate for high voltage isolation, as will be obvious to those of skill in the art. Preferably, a high vacuum grade chamber is formed that provides and anode surface that is thermally conductive to the exterior of the chamber and a means to provide a high voltage cathode and filament electrical connection is provided. The chamber is preferably a cylindrical form so that it is rotatable for high power application but also may be non-rotatable for low power application.

As shown in FIG. 8, an end member 80 for providing electrical isolation to provide a high voltage connection to the cathode 44 is provided. Various methods for providing the high voltage and filament connections may be implemented. One such embodiment includes two isolated connections on a coaxial shaft to provide the two filament connections both of which are at high potential. The external bearing that support the envelope rotational shaft also provide the high voltage and filament connections. The connections could also be implemented by a brush assembly. On the interior shaft, the cathode assemble is also on a bearing assembly. This assembly is held stationary by a set of permanent magnets 82 to hold the cathode in fixed position as the envelope rotates. The filament connections 84 may be made through the bearing assembly. This represents just one embodiment of providing the high voltage/filament connections for the invention. All other means for providing the connection and filament power such as transformer coupled coils or induced current systems are also applicable.

The envelope assembly 70 is located in a suitable housing assembly 74 that contains the cooling medium 72 for the envelope such as oil or another appropriate cooling fluid. A means for providing a flow of the cooling medium 72 and some form of heat exchange system (not shown) may be included. A high voltage connection 88 is provided to connect the high voltage to the cathode assembly as well as the power for the filament. An X-ray window 90 is provided to provide a low attenuation path for the exiting X-ray generated at the anode focal spot. Optional assemblies 92 may be incorporated that form a thin flow path between the envelope external surface and the cooling medium. If this gap is made small, preferential flow properties are achieved that reduce fluid frictional forces such as achieved in journal bearing. Various means may be provided to force cooling medium through these gaps.

A motor 94 to provide the envelope rotation is provided. This may be located within the housing within the cooling medium or external to the cooling medium or housing. The rotational rate is application dependent and any rotation rate may be employed.

It will be appreciated that x-ray tubes having one of the herein described transmission anode assemblies may benefit from higher x-ray yields. As used herein, the x-ray yield refers to the x-ray output per unit electron input power. This yield may be defined as the x-ray exposure rate (in roentgens per second) per electron kilowatt input power. As an example, the exposure rate is measured by standard methods with an ionization chamber at a distance of 100 cm from the focal spot in the x-ray tube. These yields were determined by appropriate Monte Carlo calculations for both an exemplary transmission anode x-ray tube and a convention reflection anode x-ray tube.

For the transmission anode x-ray tube, it is assumed that the anode has tungsten x-ray generating layer with a thicknesses approximately equal to one-third of the range of the incident electron energy (see FIG. 3) with a 3 millimeter silicon carbide substrate. For the conventional reflection anode x-ray tube, it is assumed that the anode inclination (AI) angle is 10 degrees and the x-ray emission (XE) angle is 90 degrees, and the emerging x-ray beam is transmitted through a 3 mm external aluminum filter (for example, as is depicted in FIG. 1). The results of the Monte Carlo calculations show that the maximum values for the x-ray yields are obtained with the transmission anode where both the anode inclination angle and the x-ray emission angle are equal to zero. The curves in FIG. 6, which summarize some of these calculations, show that in the region from 100 to 300 kilovolts, the transmission anode x-ray tube has x-ray yields that are factors of approximately 1.7 to 2.0 times greater than the Yields of the conventional reflection anode x-ray tube.

Figure 2:
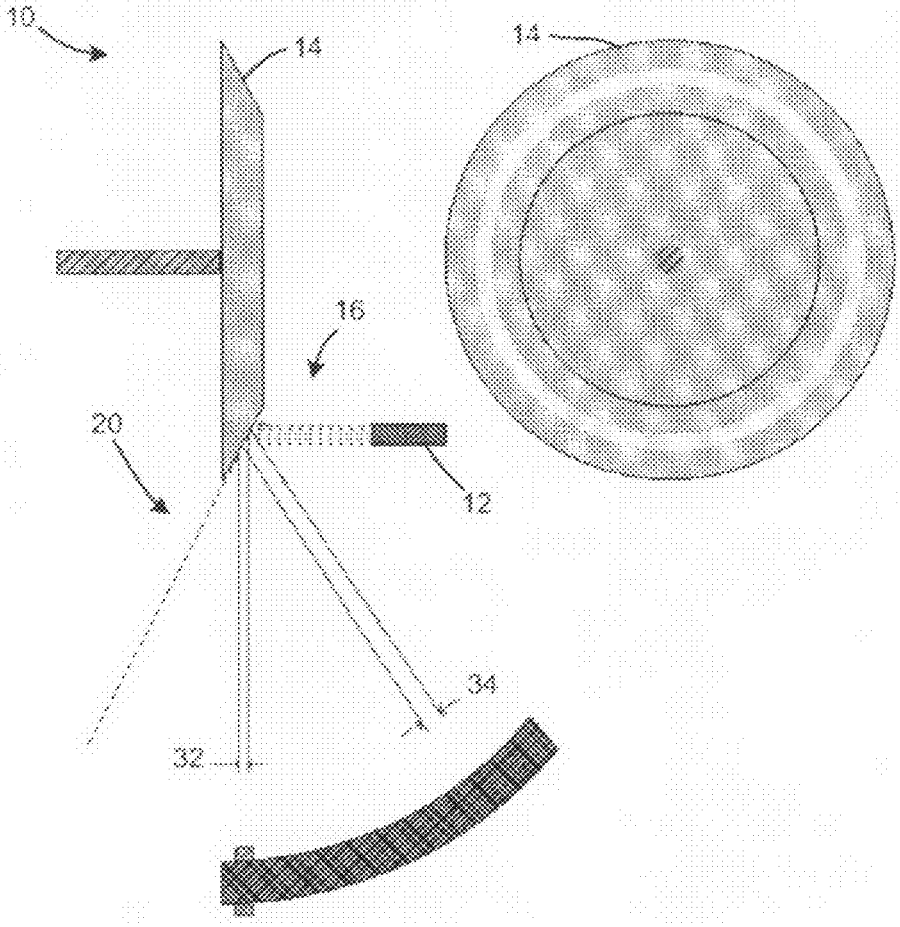
Prior Art FIG. 2
FIG. 2 is a diagrammatic illustration of a conventional x-ray tube in a computed tomography (CT) environment.

Another potential advantage of the herein described transmission anode x-ray tube is a smaller focal spot size. Present-day reflection anode x-ray tubes have a line focal spot size with a projected size equal to the line width when observed at a 90 degree emission angle (see, for example FIG. 2). For cone-shaped x-ray beams, the projected focal spot size increases from the line width to the line length when observed over the angular region of the cone vertex angle. This condition is characterized as focal spot blooming.

In comparison, the cone shaped beam produced by the transmission anode has axial symmetry such that the focal spot size decreases when observed over the angular region from the zero degree X-RAY EMISSION angle at the cone axis to half of the cone vertex angle. Accordingly, the transmission anode effectively reduces, if not, eliminates focal spot blooming.

Also, for reflection anode x-ray tubes, the focal spot size determines the area of the single focal track, and this area decreases as the focal spot size decreases. In comparison, the above-described rotating and oscillating cylindrical transmission anode x-ray tube transforms the single focal track area to a much larger area with increased radiation cooling. This increased area permits the same electron input power to be used even though there is a reduction in the size of the focal spot.

Another potential advantage of the herein described transmission anode x-ray tubes lies in larger vertex angles for cone-shaped x-ray beams. The transmission anode x-ray tube can provide cone-shaped x-ray beams with wider vertex angles compared to conventional reflection anode x-ray tubes. The cone-shaped beam is defined with its vertex at the anode focal spot and with its axis aligned with the incident electron beam axis. Accordingly, the cone vertex angle is not restricted by the anode heel effect as encountered in reflection anode x-ray tubes, and may be practically increased to values as large as 90 degrees. In addition, the apparent area of the focal spot decreases as the off-axis angle increases. This axial symmetry eliminates the blooming effect of the focal spot size that exists in reflection anode tubes, which may show size increases by factors of five.

Another potential advantage of the herein described transmission anode x-ray tube resides in higher electron peak input power for pulsed cone-shaped x-ray beams. The maximum permissible electron input power is determined by the requirement that the focal spot temperature does not exceed the melting temperature of the focal spot material (e.g., tungsten). With a rotating anode, the focal spot region moves along a circular focal track and reaches a peak temperature during the time period (dwell time) that it passes through the electron beam. For the remaining time in the rotation cycle, the temperature of the focal track outside the position of the electron beam is reduced to a "pre-temperature" that exists before the cycle is repeated. For short exposure times of a fraction of a second (as is the requirement for pulsed electron beams with very high input powers), the pre-temperature is negligible compared to the peak temperature, which now is approximately equal to the maximum focal spot temperature that is obtained in a rotation cycle.

The peak temperature depends on the focal spot size and the dwell time. For a cone x-ray beam, the focal spot size is assumed to be the same for both the reflection and transmission anodes. (For a fan x-ray beam, the reflection anode has a larger focal spot size because it provides a smaller projected focal spot size that is the same as that for the transmission anode). Accordingly, for a cone beam and a given electron deposition energy, the peak temperature depends only on the dwell time, such that the peak temperature is inversely proportional to the rotation speed of the rotating anode or to the product of the number of rotations per minute times the diameter of the focal track.

The maximum rotation speeds that can be obtained by present day reflection anodes are limited because these anodes have a large mass with a large heat capacity, or as in the case of the Straton tube, a smaller mass with liquid cooling for the rotating anode. Both of these conditions restrict the anode rotation such that at present the maximum rotation speed is believed to be 10,000 rpm for a 7 inch diameter anode. In comparison, the maximum rotation speed for the above-described transmission anode may be increased to at least 15,000 rpm for a 6 inch diameter anode. This means that the peak electron input power can be increased by a factor of at least 1.3 over that for the reflection anode, for the same focal spot temperature.

Another potential advantage of the herein described transmission anode x-ray tube resides in higher power x-ray beams. Compared to present day reflection anode x-ray tubes, the above-described transmission anode x-ray tube has the capability of (a) increasing the x-ray beam power (or x-ray exposure rate) by a factor of approximately 1.5 for a given electron input power and exposure time, and (b) increasing the peak electron input power by a factor of at least 1.3 for pulsed cone shaped x-ray beams. This capability is possible because the x-ray emission angle is zero with respect to the incident electron beam direction, and because the anode rotation speed is a factor of at least 1.3 higher than the speed attainable by the reflection anode tube (as described previously). As a consequence, for a given electron input power and exposure time, this transmission anode tube can produce x-ray beams with enhanced power factors greater than 1.5.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. An x-ray tube comprising:

an x-ray tube envelope;

a cathode assembly disposed within the x-ray tube envelope; and a transmission anode assembly disposed within the x-ray tube envelope, wherein the transmission anode assembly comprises an x-ray generation layer disposed on an anode substrate, and wherein the anode substrate is a disc mounted for rotation about its central axis, and the x-ray generation layer is annular and concentric with the anode substrate.

2. The x-ray tube of claim 1, wherein the anode assembly is configured to receive electron energy at the x-ray generation layer and to emit x-rays through the anode substrate.

3. The x-ray tube of claim 1, wherein the x-ray generation layer has a thickness between about 5 microns and about 25 microns.

4. The x-ray tube of claim 3, wherein the anode substrate has a thickness between about 1 millimeter and 5 millimeters.

5. The x-ray tube of claim 1, wherein the x-ray generation layer is comprised of tungsten or molybdenum.

6. The x-ray tube of claim 1, wherein the anode substrate includes silicon carbide, beryllium oxide, aluminum nitride or aluminum oxide.

7. The x-ray tube of claim 1, wherein the anode assembly is configured to receive incident electron energy, and the x-ray generation layer has a thickness equal to approximately one-third of the electron range in the material of the x-ray generation layer for a given incident electron energy.

8. An x-ray tube comprising:

an x-ray tube envelope;

a cathode assembly disposed within the x-ray tube envelope; and a transmission anode assembly disposed within the x-ray tube envelope, wherein the transmission anode assembly comprises an x-ray generation layer disposed on an anode substrate mounted for rotation about its central axis;

wherein the x-ray generation layer and the anode substrate are substantially cylindrical.

9. The x-ray tube of claim 8, wherein the anode assembly is configured to receive electron energy at the x-ray generation layer and to emit x-rays through the substantially cylindrical anode substrate.

10. The x-ray tube of claim 8 wherein cathode assembly is disposed at least partially within the cylinder defined by the x-ray generation layer and anode substrate.

11. The x-ray tube of claim 8, wherein the anode substrate is mounted for translation along its central axis.

12. The x-ray tube of claim 8, wherein the anode substrate is mounted for oscillation along its central axis.

13. The x-ray tube of claim 8, wherein the anode substrate is formed as an integral part of the x-ray envelope, the x-ray envelope and integral anode substrate defining an evacuated chamber.

14. The x-ray tube of claim 8, wherein the anode substrate is thermally connected to the x-ray vacuum envelope.

15. The x-ray tube of claim 8, wherein the anode substrate cooperates with the x-ray envelope to form an evacuated chamber.

16. The x-ray tube of claim 8, further comprising an inner member disposed radially inward from the anode assembly, the inner member cooperating with the x-ray tube envelope to define a first chamber and a second chamber within the x-ray tube envelope.

17. The x-ray tube of claim 16, wherein the first chamber is an anode cooling chamber and the second chamber is an electron acceleration chamber.

18. The x-ray tube of claim 16, wherein the second chamber is maintained at a higher vacuum relative to the first chamber.

19. An x-ray tube comprising:

an x-ray tube envelope;

a cathode assembly disposed within the x-ray tube envelope; and a transmission anode assembly disposed within the x-ray tube envelope, wherein the transmission anode assembly comprises an x-ray generation layer disposed on an anode substrate, and wherein the anode substrate cooperates with the x-ray envelope to form an evacuated chamber;

wherein the anode substrate and the x-ray envelope are rotatably supported within an x-ray housing.

20. The x-ray tube of claim 19, wherein the x-ray envelope and anode substrate are in thermal contact with a cooling medium within the x-ray housing.

21. The x-ray tube of claim 19, wherein the anode substrate is in direct thermal contact with a cooling medium within the x-ray housing.

22. The x-ray tube of claim 19, wherein the x-ray envelope and anode substrate rotate in a cooling medium within the x-ray housing.

23. The x-ray tube of claim 19, further comprising an inner heat sink disposed radially inward from the anode assembly, the inner heat sink being in thermal communication with the x-ray housing.

24. The x-ray tube of claim 23, wherein the inner heat sink is substantially cylindrical and configured to absorb back-scattered electrons.

25. An anode assembly for use in an x-ray tube, the anode assembly comprising:

an x-ray generation layer disposed on an anode substrate, wherein the anode assembly is configured to have an anode inclination angle and an x-ray emission angle that are both about zero degrees, wherein the anode substrate is a disc mounted for rotation about its central axis, and the x-ray generation layer is annular and concentric with the anode substrate.

26. The anode assembly of claim 25, wherein the anode assembly is configured to receive electron energy at the x-ray generation layer and to emit x-rays through the anode substrate.

27. The anode assembly of claim 25, wherein the x-ray generation layer has a thickness between about 5 microns and about 25 microns.

28. The anode assembly of claim 27, wherein the anode substrate has a thickness of about 1 millimeter to about 5 millimeters.

29. The anode assembly of claim 25, wherein the x-ray generation layer is comprised of tungsten or molybdenum.

30. The anode assembly of claim 29, wherein the anode substrate includes silicon carbide, beryllium oxide, aluminum nitride or aluminum oxide.

31. An anode assembly, the anode assembly comprising:

an x-ray generation layer disposed on an anode substrate, wherein the anode assembly is configured to have an anode inclination angle and an x-ray emission angle that are both about zero degrees, wherein the x-ray generation layer and the anode substrate are substantially cylindrical, and wherein the anode substrate is configured to rotate about a central axis.

32. The anode assembly of claim 31, wherein the anode substrate is configured to oscillate along the central axis.

33. The anode assembly of claim 25, wherein the anode assembly is configured to receive incident electron energy, and the x-ray generation layer has a thickness equal to approximately one-third of the electron range for a given incident electron energy.

34. A method of producing an x-ray beam, comprising the steps of:

accelerating electrons from a cathode toward an anode to produce x-rays, wherein the anode includes an x-ray generation layer disposed on a substantially cylindrical substrate, rotating and oscillating the substantially cylindrical substrate such that the accelerating electrons from the cathode form a spiral focal track on the x-ray generation layer, and using the x-rays that pass through the anode to form the x-ray beam.

* * * * *